US010551145B2

(12) United States Patent
Kincel et al.

(10) Patent No.: US 10,551,145 B2
(45) Date of Patent: Feb. 4, 2020

(54) MODULAR KEY-SLOT ACCESSORY MOUNTING SYSTEM FOR A FIREARM

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 16/164,389

(22) Filed: Oct. 18, 2018

(65) Prior Publication Data

US 2019/0113306 A1 Apr. 18, 2019

Related U.S. Application Data

(60) Provisional application No. 62/574,002, filed on Oct. 18, 2017.

(51) Int. Cl.

| | |
|---|---|
| ***F41C 23/16*** | (2006.01) |
| ***F41C 27/00*** | (2006.01) |
| ***F41C 23/02*** | (2006.01) |

(52) U.S. Cl.

CPC ..... *F41C 23/16* (2013.01); *F41C 27/00* (2013.01); *F41C 23/02* (2013.01)

(58) Field of Classification Search

CPC ..... F41C 23/02; F41C 23/16; F41C 27/00

See application file for complete search history.

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |
| 3,066,375 | A | 12/1962 | Knowles et al. |
| 3,177,587 | A | 4/1965 | Hart |
| 3,512,653 | A | 5/1970 | Erismann |
| 3,559,940 | A | 2/1971 | Kruzell |
| 3,798,818 | A | 3/1974 | Casull |

(Continued)

FOREIGN PATENT DOCUMENTS

| | | |
|---|---|---|
| EP | 1832835 | 9/2007 |
| WO | WO2013010515 A1 | 1/2013 |

OTHER PUBLICATIONS

Magpul, "The M-LOK System," brochure (2014) 10 pages, www.magpul.com/foundations.

(Continued)

*Primary Examiner* — Joshua T Semick

(74) *Attorney, Agent, or Firm* — Michael Best & Friedrich LLP

(57) ABSTRACT

An accessory mounting system for use on a firearm includes an elongated opening having first and second ends and an entry aperture between the first and second ends. A fastener with a major dimension larger than the minor dimension of the elongated opening, but small than the width of the entry aperture can be inserted into the entry aperture and slid toward either of the first and second ends of the elongated opening. The fastener may be, for example, a T-nut or a screw-like fastener with a circular head. If a T-nut is used, it can be inserted into the elongated opening transverse to the elongated opening and slide to either end in the transverse orientation so it spans across the elongated opening without having to turn it.

13 Claims, 14 Drawing Sheets

(56) References Cited

U.S. PATENT DOCUMENTS 3,844,627 A 10/1974 Gutner
3,861,070 A 1/1975 Wild et al.
4,167,884 A 9/1979 Santanna
4,663,875 A 5/1987 Tatro
4,905,396 A 3/1990 Bechtel
4,959,908 A 10/1990 Weyrauch
5,078,215 A 1/1992 Nau
5,590,484 A 1/1997 Mooney et al.
5,603,594 A 2/1997 Lincoln
5,632,108 A 5/1997 Ruger et al.
6,609,321 B2 8/2003 Faifer
6,836,990 B2 1/2005 Shiloni
6,874,269 B2 4/2005 Chen et al.
7,216,451 B1 5/2007 Troy
7,325,352 B2 2/2008 Matthews et al.
7,430,829 B2 10/2008 Murello
7,464,495 B2 12/2008 Cahill
D613,811 S 4/2010 Swan
7,712,242 B2 5/2010 Matthews et al.
7,716,865 B2 5/2010 Daniel et al.
7,770,317 B1 8/2010 Tankersley
7,793,452 B1 9/2010 Samson et al.
D636,453 S 4/2011 Fitzpatrick et al.
D641,450 S 7/2011 Ding
7,971,384 B2 7/2011 Lippard
8,006,430 B2 8/2011 Wang
8,051,595 B2 11/2011 Hochstrate et al.
8,141,289 B2 3/2012 Gomez et al.
8,201,353 B1 6/2012 Swan
8,245,428 B2 8/2012 Griffin
8,312,668 B2 11/2012 Kincel
8,438,770 B2 5/2013 Troy
8,490,316 B2 7/2013 Kincel et al.
8,539,708 B2 9/2013 Kenney et al.
8,578,647 B2 11/2013 Storch et al.
8,607,490 B1 12/2013 Zinsner
D703,286 S 4/2014 Chen et al.
8,739,448 B2 6/2014 Kimmel et al.
8,752,320 B2 6/2014 Masters
D710,964 S 8/2014 Chvala
8,819,980 B2 9/2014 Geissele
D717,907 S 11/2014 Montes
D717,908 S 11/2014 Montes
D720,421 S 12/2014 Chen
8,904,691 B1 12/2014 Kincel
D721,407 S 1/2015 Chu
8,925,236 B1 1/2015 Mayberry et al.
D722,356 S 2/2015 Keller et al.
D725,723 S 3/2015 Eddie
9,103,625 B2 * 8/2015 Masters ..... F41C 23/16
9,157,697 B2 10/2015 Leclair
D744,054 S 11/2015 Peterson et al.
D746,399 S 12/2015 Folkestad, II et al.
D746,936 S 1/2016 Huang
9,239,209 B2 1/2016 Mayberry et al.
9,239,210 B2 1/2016 Mayberry et al.
D749,181 S 2/2016 Hu
9,297,599 B2 3/2016 Underwood et al.
9,303,949 B1 4/2016 Oglesby
D755,338 S 5/2016 Slank
D757,201 S 5/2016 Meier
D757,204 S 5/2016 Chow et al.
D757,878 S 5/2016 Barfoot et al.
9,377,274 B2 6/2016 Kincel
9,383,163 B2 7/2016 Kincel et al.
9,389,043 B1 7/2016 Zhang
9,429,388 B2 8/2016 Mayberry et al.
D768,800 S 10/2016 Willits
9,459,078 B1 10/2016 Kincel
9,464,865 B2 10/2016 Shea et al.
9,470,472 B2 10/2016 Kincel et al.
9,476,672 B2 10/2016 Wells et al.
D771,216 S 11/2016 Dubois
9,523,554 B2 12/2016 Mayberry et al.
D779,013 S 2/2017 Cheng et al.
D779,014 S 2/2017 Cheng et al.
9,581,412 B2 2/2017 Cheng et al.
9,599,439 B1 3/2017 Sylvester
D783,760 S 4/2017 Pavlick
D783,761 S 4/2017 Pavlick
D785,743 S 5/2017 Pavlick
9,696,112 B2 7/2017 Gottzmann et al.
9,709,358 B2 7/2017 Kincel
D795,986 S 8/2017 Frederickson et al.
9,766,035 B2 * 9/2017 Storch ..... F41C 23/16
9,772,161 B1 * 9/2017 Cheng ..... F41C 23/16
9,791,239 B1 10/2017 Kincel et al.
9,964,380 B1 * 5/2018 Oglesby ..... F41C 23/16
10,126,094 B2 11/2018 Kincel et al.
2001/0045046 A1 11/2001 Otteman
2004/0009034 A1 1/2004 Miller
2005/0268512 A1 12/2005 Battaglia
2006/0191183 A1 8/2006 Griffin
2008/0092422 A1 4/2008 Daniel et al.
2008/0301994 A1 12/2008 Langevin et al.
2009/0000175 A1 1/2009 Potterfield et al.
2009/0100734 A1 4/2009 Swan et al.
2009/0178325 A1 7/2009 Veilleux
2010/0122485 A1 5/2010 Kincel
2010/0242332 A1 9/2010 Teetzel et al.
2010/0319231 A1 12/2010 Stone et al.
2011/0032694 A1 2/2011 Swan et al.
2011/0126443 A1 6/2011 Sirois
2011/0192066 A1 8/2011 Kimmel et al.
2012/0042557 A1 2/2012 Gomez et al.
2012/0097807 A1 4/2012 Rees
2012/0124880 A1 5/2012 Leclair
2012/0016743 A1 7/2012 Masters
2012/0167434 A1 7/2012 Masters
2012/0180359 A1 7/2012 Fitzpatrick et al.
2012/0186123 A1 7/2012 Troy et al.
2012/0311908 A1 12/2012 Kenney et al.
2013/0031820 A1 2/2013 Deros
2013/0036646 A1 2/2013 Rubac et al.
2013/0104441 A1 5/2013 Kincel
2013/0133238 A1 5/2013 Quetschke
2013/0276341 A1 10/2013 Wells et al.
2013/0318848 A1 12/2013 Kincel
2014/0000142 A1 1/2014 Patel
2014/0026459 A1 1/2014 Yan et al.
2014/0041273 A1 2/2014 Masters
2014/0082990 A1 3/2014 Lee
2014/0115938 A1 5/2014 Jarboe
2014/0115939 A1 5/2014 Troy et al.
2014/0115940 A1 5/2014 Bonelli et al.
2014/0130390 A1 5/2014 Geissele
2014/0204566 A1 7/2014 Kay
2014/0373419 A1 12/2014 Leclair
2015/0000171 A1 1/2015 Roberts
2015/0198408 A1 7/2015 Kincel et al.
2015/0219422 A1 8/2015 Kincel
2015/0267993 A1 9/2015 Cheng et al.
2015/0285583 A1 10/2015 Mayberry et al.
2015/0285584 A1 10/2015 Mayberry et al.
2015/0285585 A1 10/2015 Hewes et al.
2015/0316347 A1 11/2015 Shea et al.
2015/0369555 A1 12/2015 Daniel et al.
2015/0369558 A1 12/2015 Gottzmann
2016/0010946 A1 1/2016 Gibbons et al.
2016/0025120 A1 1/2016 Swan et al.
2016/0091277 A1 3/2016 Mayberry et al.
2016/0169617 A1 6/2016 Daley, Jr.
2016/0187100 A1 6/2016 Mayberry et al.
2016/0349011 A1 * 12/2016 Jen ..... F41G 11/001
2017/0016695 A1 1/2017 Willits
2017/0067718 A1 3/2017 Mayberry et al.
2017/0205183 A1 7/2017 Ding et al.
2017/0261276 A1 9/2017 Morris

(56) References Cited

U.S. PATENT DOCUMENTS

| | | | |
|---|---|---|---|
| 2017/0307328 | A1 | 10/2017 | Shelton et al. |
| 2018/0023919 | A1 | 1/2018 | Kincel et al. |

OTHER PUBLICATIONS

Magpul, "The M-LOK System," brochure (2014) pp. 1-10, www.magpul.com/foundations.

"Noveske Photograph Oct. 4, 2011" Photograph of accessory mounting assembly, provided by third party and dated Oct. 4, 2011.

"Noveske CAD Image Oct. 4, 2011" Screen shot of CAD model illustrating handguard, provided by third party and dated Oct. 4, 2011.

"Noveske Facebook Apr. 1, 2016" Screen shot of Facebook post by Noveske Rifleworks dated Apr. 1, 2016.

* cited by examiner

MODULAR KEY-SLOT ACCESSORY MOUNTING SYSTEM FOR A FIREARM

BACKGROUND

The present invention relates to a modular key-slot accessory mounting system for a firearm.

Firearms such as the AR15, M16, M4 are known to include a handguard mounted to the upper receiver and extending around a portion of the barrel. The handguard can be grasped by the operator. It is known to mount accessories such as flashlights, scopes, and handgrips to the handguard and for this purpose several mounting systems are well known in the industry.

One known accessory mounting system is disclosed in U.S. Pat. No. 8,925,236 to Mayberry et al. This system includes a handguard with slots having uniform width and a length between first and second ends. A T-nut of the accessory to be mounted to this system includes a major dimension and a minor dimension. The major dimension is wider than the width of the slot but shorter than the length of the slot and the minor dimension is not as wide as the width of the slot. To mount the accessory to the handguard, the T-nut is turned to align the major dimension with the length of the slot. After the head of the T-nut has been inserted into the slot and is clear, the T-nut is turned so the major dimension extends across (e.g., perpendicular to) the slot. The accessory is then slid in the slot until a recoil lug adjacent the T-nut engages the first end of the slot and another recoil lug engages the second end of the slot. The T-nut is then tightened to clamp the accessory to the handguard with the head of the T-nut extending across the elongated opening.

Another known system is illustrated in U.S. Pat. No. 9,377,274 to Kincel. This system includes a handguard with keyhole-shaped slots. Each keyhole-shaped slot (referred to as a "void 210" in the patent) has a circular entry aperture ("first region 215") and an elongated opening ("second region 220") extending away from the entry aperture to a distal end. An accessory to be mounted to this system includes fastener ("coupling member 225") including a head that passes through the entry aperture but is wider than the elongated opening. To mount the accessory this system, the heads of first and second fasteners are inserted into the entry apertures of adjacent keyhole-shaped slots and slide into the elongated openings. The fasteners are then tightened to clamp the accessory to the handguard with the head of the fasteners T-nut extending across the elongated opening.

SUMMARY

In one embodiment, the invention provides an attachment system for securing accessories to a firearm having a barrel. The attachment system includes a handguard extending along a portion of the barrel, and a plurality of slots in the handguard for receiving attachments. Each slot defines an elongated opening extending between first and second opposite ends. The elongated opening has a first width, and an entry opening interrupting the elongated opening between the first and second ends. The entry opening includes a second width larger than the first width. The second width is larger than a major dimension of a fastener head of an accessory to be secured to the attachment system and the first width is smaller than the major dimension such that the fastener head is insertable into the slot through the entry opening, movable in the slot toward either of the first and second ends, and securable to the handguard by tightening the fastener head against the handguard.

In another embodiment, the invention provides an attachment system for securing an accessory to a firearm. The attachment system includes a rail with a plurality of slots, each slot defining an elongated opening extending between first and second opposite ends. The elongated opening has a first width and an entry opening interrupting the elongated opening between the first and second ends. The entry opening has a second width larger than the first width. The attachment system also includes a fastener having a fastener head defining a major dimension. The major dimension is larger than the first width and smaller than the second width such that the fastener head is insertable into the slot through the entry opening, movable in the slot toward either of the first and second ends, and securable to the rail by tightening the fastener head against the rail.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
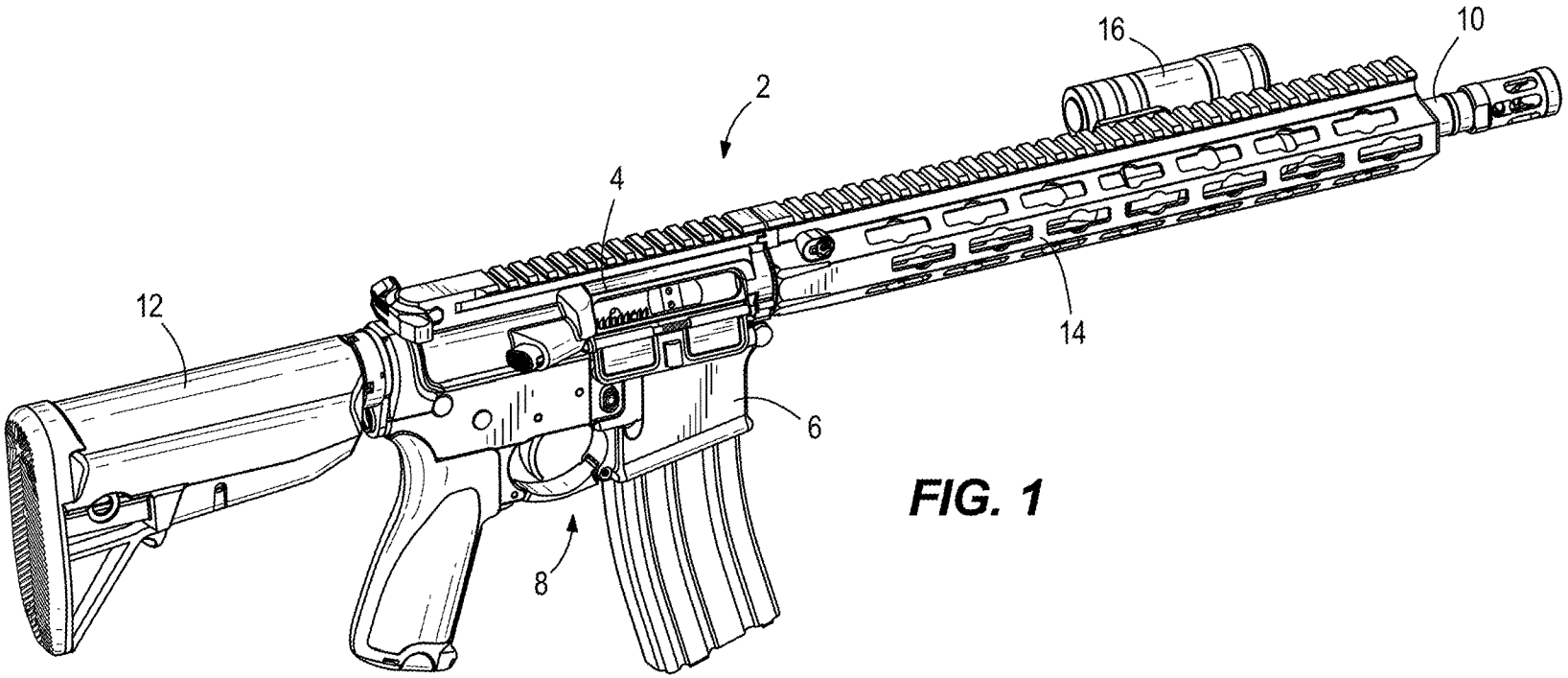
FIG. 1 is a side view of an exemplary firearm to which an accessory can be attached.

With reference to FIG. 1, a firearm 2 includes an upper receiver 4, a lower receiver 6 that cooperates with the upper receiver 4 to define a main body 8 of the firearm 2, and a barrel 10 extending from the upper receiver 4. A stock 12 is coupled to the main body 8 opposite the barrel 10, and a handguard 14 surrounds a portion of the barrel 10 adjacent the upper receiver 4. The illustrated firearm 2 also includes an accessory 16 (e.g., a flashlight, scope, sight, handgrip, etc.) removably coupled to the handguard 14. In some embodiments, one or more accessories may be removably coupled to other parts of the firearm 2, such as the upper receiver 4.

FIGS. 2-5D illustrate an attachment system 20 according to one embodiment, for attaching an accessory 16 to the firearm 2 of FIG. 1 or to any other firearm. Each accessory 16 includes an accessory mount 22 which interfaces with a rail 24 of the attachment system 20. For the sake of simplicity, only the accessory mount 22 will be illustrated. The attachment system 20 includes the above-mentioned rail 24, which has a plurality of slots 28. The illustrated rail 24 includes three slots 28 arranged along a single row; however, the rail 24 can include any number of rows of two or more slots 28. The rail 24 is an integral part of the handguard 14 in some embodiments such that the slots 28 are formed in the handguard 14. Alternatively, the rail 24 can be integrated into other parts of the firearm 2 (e.g., the upper receiver 4), or the rail 24 can be a separate part attached to the firearm 2 in any number of ways.

Figure 4:
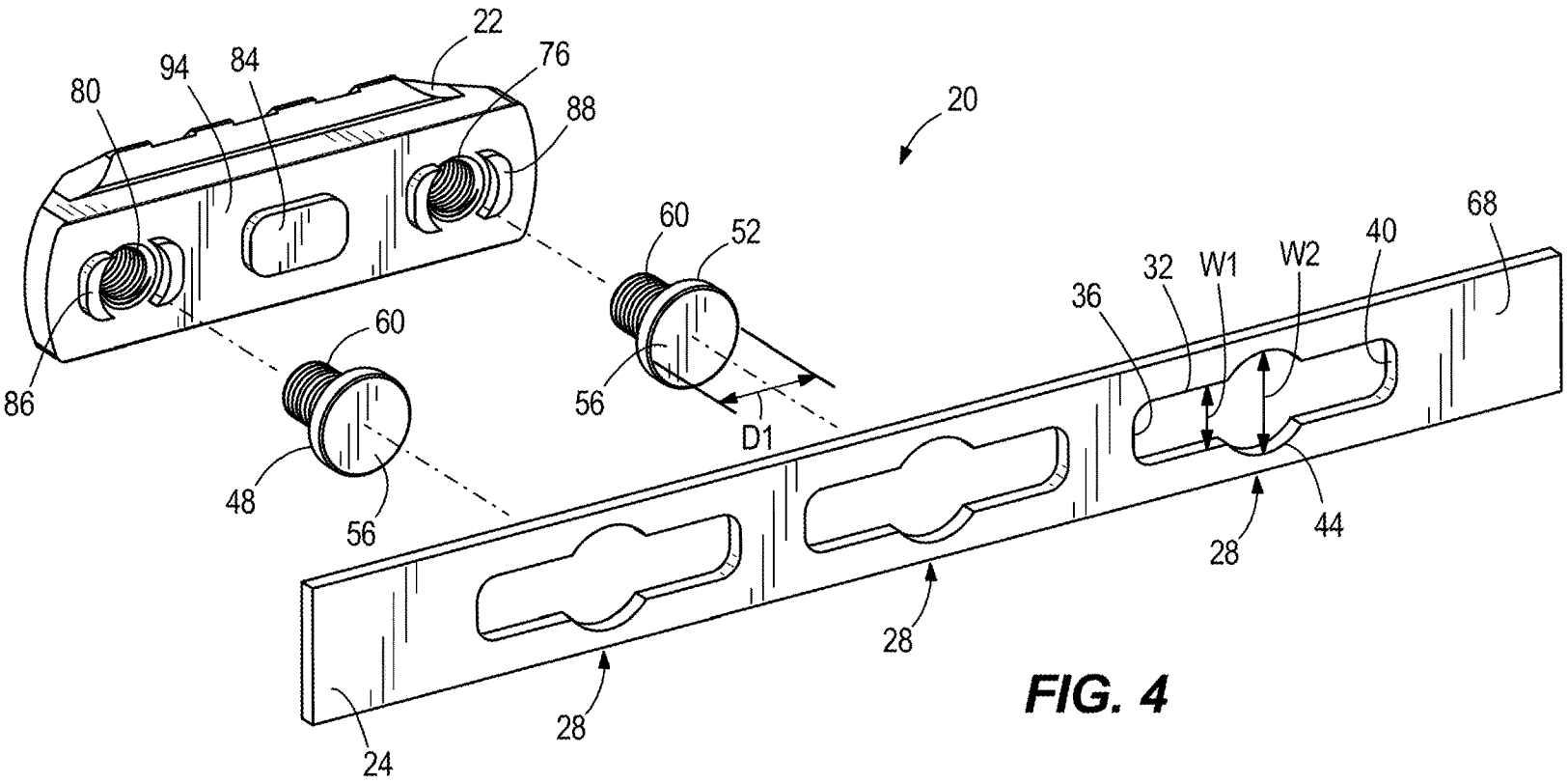
FIG. 4 is an exploded view of the attachment system of FIG. 2.

Referring to FIG. 4, each of the slots 28 in the rail 24 defines an elongated opening 32 extending between first and second opposite ends 36, 40, and an entry opening 44 interrupting the elongated opening 32 between the first and second ends 36, 40. In the illustrated embodiment, the entry opening 44 is centered between the first and second ends 36, 40. In other constructions, the entry opening 44 can be positioned closer to either one of the ends 36, 40, provided at least a portion of the elongated opening 32 extends in both directions (i.e., toward each of the first and second ends 36, 40) from the entry opening 44. Stated another way, the entry opening 44 is not at either end 36, 40 but is instead positioned somewhere along the elongated opening 32 between the ends 36, 40. The elongated opening 32 defines a first width W1, and the entry opening 44 defines a second width W2 that is greater than the first width W1. The illustrated entry opening 44 defines an arc length of a circle on either side of the elongated opening 32 and can therefore be referred to as a circular opening in the illustrated construction. The second width W2 may therefore be referred to as a diameter of the entry opening 44. In other embodiments, the entry opening 44 can have other shapes (e.g., square, hexagonal, elliptical, etc.).

With continued reference to FIG. 4, the attachment system 20 further includes first and second fasteners 48, 52. Each of the fasteners 48, 52 includes a head 56 and a threaded shank 60. The head 56 defines a major dimension or diameter D1 that is smaller than the second width W2 but larger than the first width W1. Accordingly, the head 56 is insertable into one of the slots 28 only through the entry opening 44, and the head 56 cannot be removed from the slot 28 except when aligned with the entry opening 44. In addition, an underside 64 (FIG. 3) of the head is engageable with an underside 68 of the rail 24 at a position along the slot 28 between the entry opening 44 and either one of the first and second ends 36, 40. In the illustrated embodiment, the underside 64 of the head 56 is flat. Alternatively, the underside 64 of the head 56 may have a tapered or beveled shape to compliment a taper or beveled edge of the slot 28 for a more secure mating interface.

Figure 2:
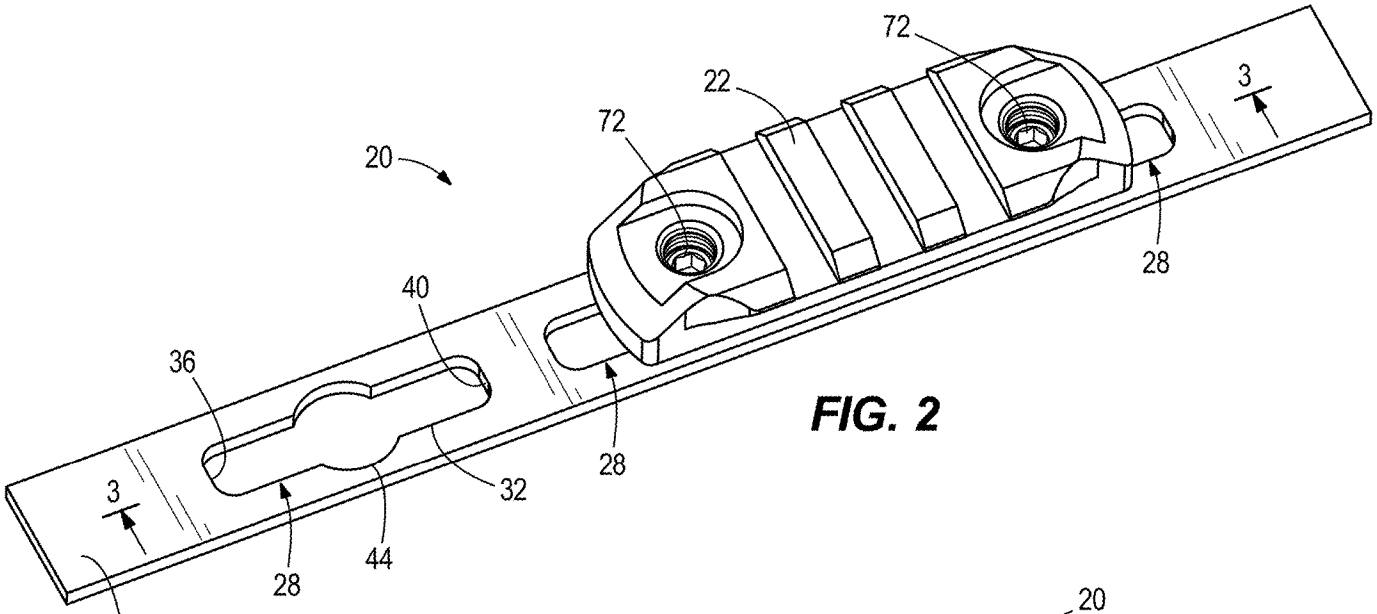
FIG. 2 is an exploded perspective view of an attachment system according to an embodiment of the invention, which may be used to attach accessories to the firearm of FIG. 1.
Figure 3:
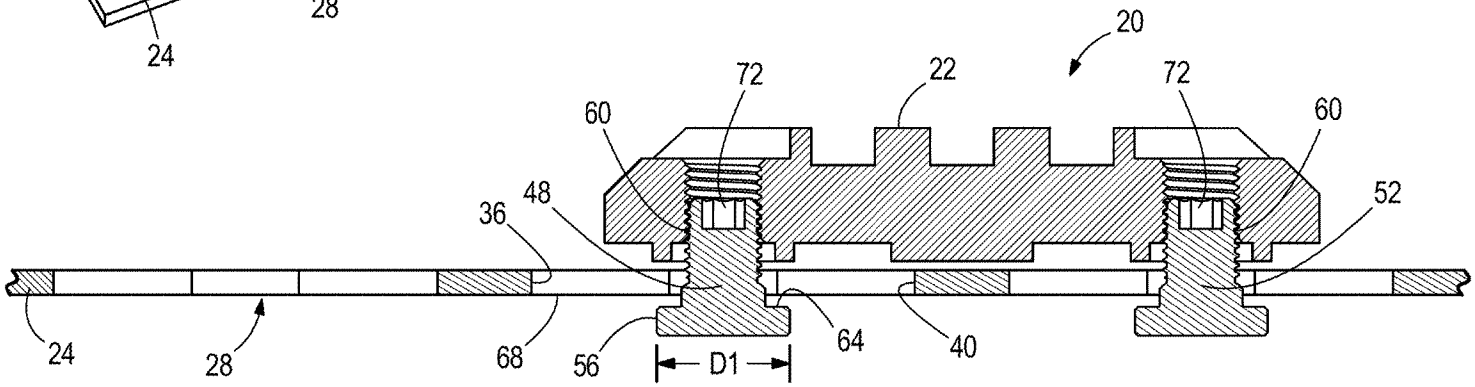
FIG. 3 is a cross-sectional view of the attachment system of FIG. 2 taken along line 3-3 in FIG. 2.

With reference to FIG. 2, unlike a conventional fastener, which features a drive region at the head of the fastener, the illustrated first and second fasteners 48, 52 are inverted such that a drive region 72 is provided at an end of the threaded shank 60 opposite the head 56. The drive region 72 can include any tool-engaging feature that facilitates torque transfer to the fastener 48, 52. For example, the drive region 72 can include a hexagonal, square, flat-head, Philips, or star-type tool-engaging feature for a customized tool or a more traditional tool commonly referred to as a screw driver, Allen wrench, hex key, or the like.

Referring to FIG. 4, the accessory mount 22 includes first and second threaded bores 76, 80 configured to receive the threaded shanks 60 of the first and second fasteners 48, 52, respectively. In some embodiments, the accessory mount 22 may include more than two threaded bores. The threaded shanks 60 and threaded bores 76, 80 are preferably left-hand threaded, such that clockwise rotation of the fasteners 48, 52 (when viewed from the drive region 72, such as in the orientation of FIG. 2) moves the fasteners 48, 52 deeper into the threaded bores 76, 80 to decrease the distance between the head 56 and the accessory mount 22. In other words, the threads are opposite the threads of a traditional fastener having the drive region on the head, so that the operator intuitively rotates the fastener clockwise to tighten and counterclockwise to loosen when viewing the fasteners 48, 52 from the end with the drive region 72 (which for the fasteners 48, 52 is the opposite end from a traditional fastener).

The illustrated accessory mount 22 further includes a center recoil lug 84 and first and second split recoil lugs 86, 88 that at least partially surround or embrace the first and second threaded bores 76, 80. The recoil lugs 84, 86, 88 project from a bottom side 94 of the accessory mount 22. The recoil lugs 84, 86, 88 are engageable with the slot 28 to transmit at least a portion of recoil forces that occur when firing the firearm 2 directly to the accessory mount 22 (rather than through the first and second fasteners 48, 52). Thus, the recoil lugs 84, 86, 88 may advantageously reduce wear on the fasteners 48, 52 and prolong their useful life. In addition, the recoil lugs 84, 86, 88 advantageously inhibit the accessory mount 22 from shifting along the rail 24 due to recoil. In some embodiments, one or more of the recoil lugs 84, 86, 88 may be omitted. The engagement of the recoil lugs 84, 86, 88 on the ends 36, 40 of the slots 28 also reduces exposure of the fasteners 48, 52 to vibratory forces that might jiggle the fasteners 48, 52 loose during operation of the firearm 2.

Figure 5A:
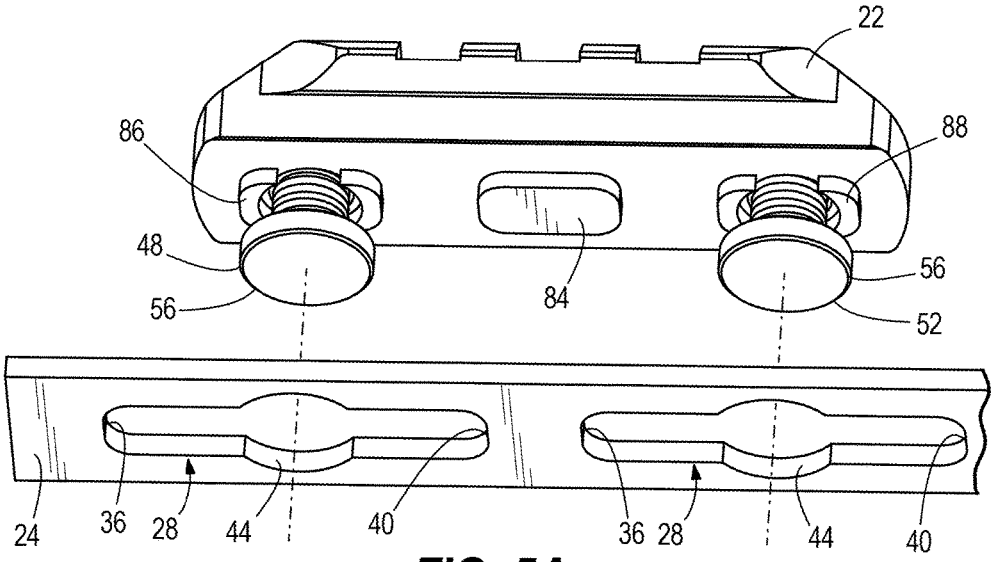
FIGS. 5A-5D are perspective views illustrating operation of the attachment system of FIG. 2.
Figure 5B:
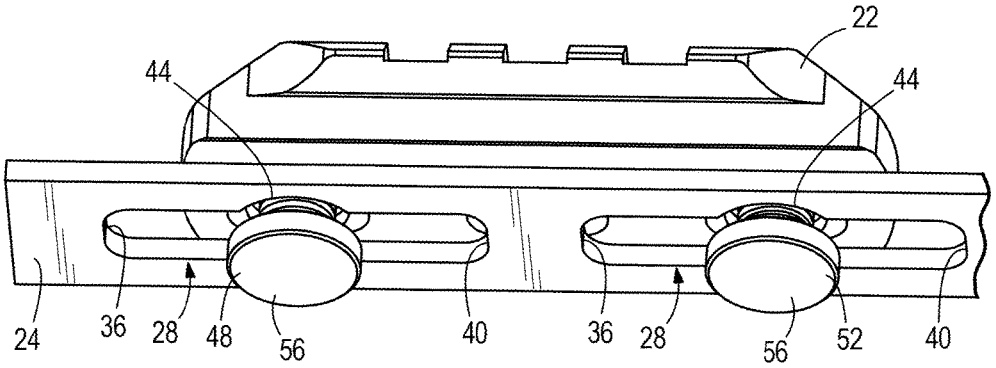
Figure 5C:
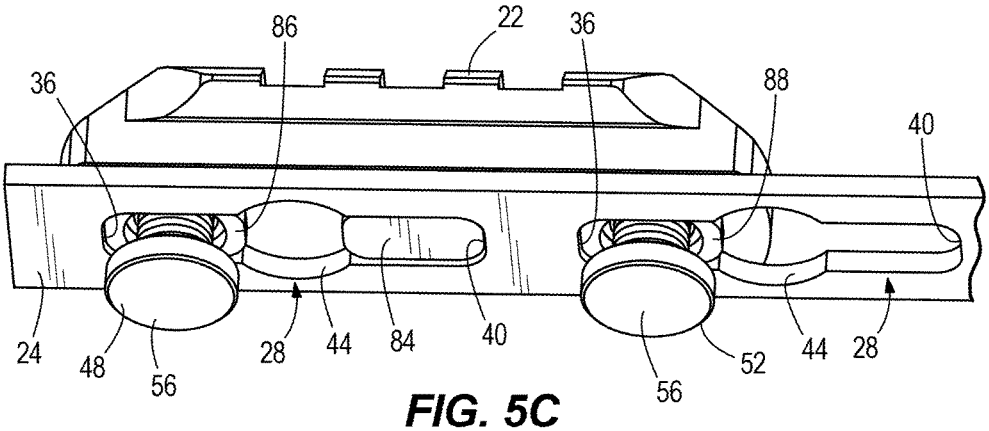
Figure 5D:
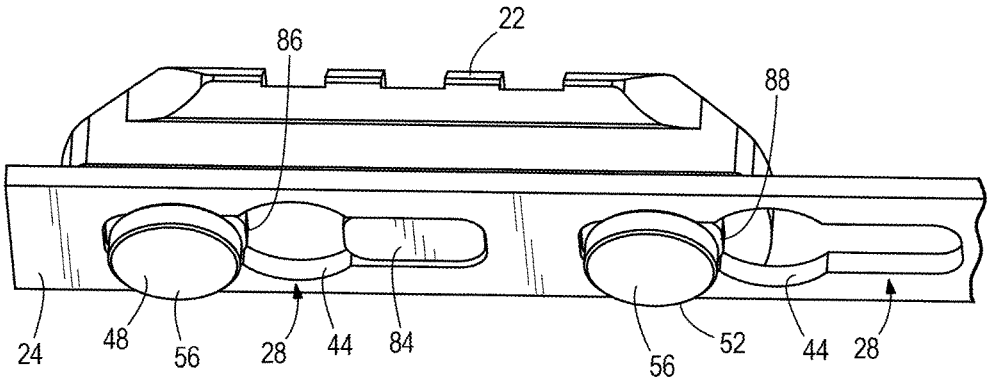

In operation, an operator uses the attachment system 20 to couple the accessory mount 22 to the rail 24 by first aligning the heads 56 of the first and second fasteners 48, 52 with the entry openings 44 of two adjacent slots 28 (FIG. 5A). Next, the operator moves the accessory mount 22 toward the rail 24 to insert the heads 56 of the fasteners 48, 52 through the entry openings 44 (FIG. 5B). The operator then slides the accessory mount 22 (and with it, the fasteners 48, 52) to move the fasteners 48, 52 toward either the first end 36 or the second end 40 of the slots 28. In the illustrated embodiment, the fasteners 48, 52 are moved toward the first end 36. As the fasteners 48, 52 approach the first end 36, the center recoil lug 84 aligns with the slot 28 receiving the first fastener 48 (FIG. 5C), and the accessory mount 22 can then be moved slightly closer to the rail 24 (by a distance equal to the projecting distance of the center recoil lug 54). In this position, the first split recoil lug 86 abuts the first end 36 of the slot 28 receiving the first fastener 48, the center recoil lug 84 abuts the second end 40 of the slot 28 receiving the first fastener 48, and the second split recoil lug 88 abuts the first end 36 of the slot 28 receiving the second fastener 52. As used herein, the term "abuts" requires close proximity but not necessarily actual or complete contact, subject to conventional manufacturing tolerances. Finally, the operator tightens each fastener 48, 52 to clamp the rail 24 between the underside 64 of the head 56 and the accessory mount 22, thereby securing the accessory mount 22 to the rail 24 (FIG. 5D). To remove the accessory mount 22, the operator loosens the fasteners 48, 52, lifts up on the accessory mount 22 to withdraw the recoil lugs 84, 86, 88 from the slots 28, then slides the accessory mount 22 to align the fastener heads 56 with the entry openings 44.

FIGS. 6-9D illustrate an attachment system 220 according to another embodiment. The attachment system 220 is similar to the attachment system 20 described above with reference to FIGS. 1-5D. Accordingly, features and elements of the attachment system 220 of FIGS. 6-9D corresponding with features and elements of the attachment system 20 of FIGS. 1-5D are given like reference numbers plus 200. In addition, the following description focuses primarily on differences between the attachment system 220 and the attachment system 20.

Figure 6:
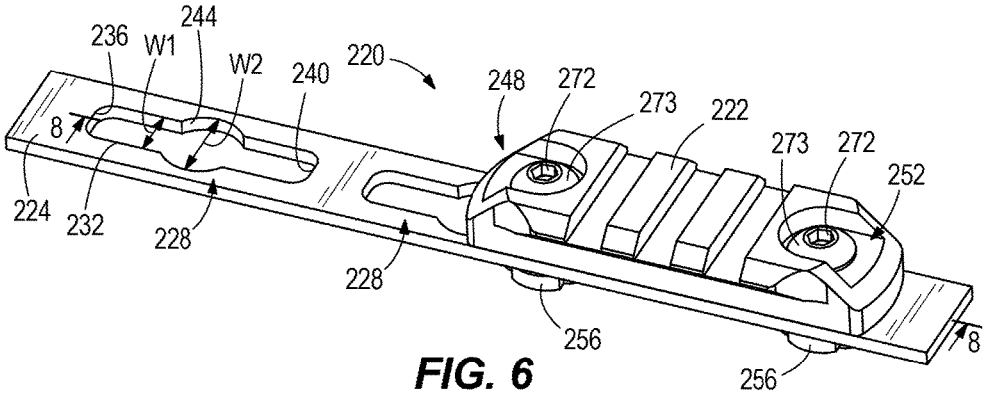
FIG. 6 is a perspective view of an attachment system according to another embodiment of the invention, which may be used to attach accessories to the firearm of FIG. 1.

The attachment system 220 includes a rail 224 and first and second fasteners 248, 252. Each of the fasteners 248, 252 of the attachment system 220 is a fastener assembly including a head or nut 256 and a threaded member 260 that is in threaded engagement with the nut 256. Each of the threaded members 260 includes a drive region 272 provided at an end of the threaded member 260 opposite the nut 256 (FIG. 6). In the illustrated embodiment, the threaded members 260 are cap screws, and each includes an enlarged flange 273 at the drive region 272. The threaded members 260 and nuts 256 are preferably left-hand threaded, such that clockwise rotation (when viewed from the drive region 272, such as in the orientation of FIG. 6) of each threaded member 260 relative to the corresponding nut 256 causes the nut 256 to move along the threaded member 260 toward the flange 273.

Figure 7:
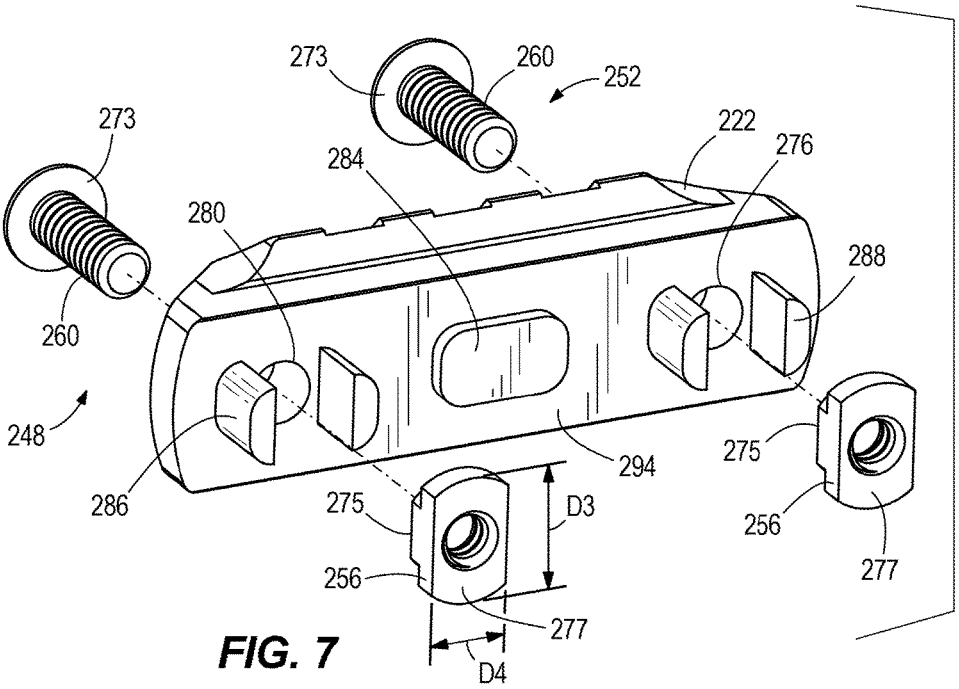
FIG. 7 is an exploded perspective view of the attachment system of FIG. 6.

With reference to FIG. 7, the illustrated nuts 256 are generally T-shaped and include a stem portion 275 and a flange portion 277. The flange portion 277 defines a major dimension D3 and a minor dimension D4 that is less that the major dimension D3. The sides of the flange portions 277 along the major dimension D3 define flat surfaces. The major dimension D3 is smaller than the second width W2 defined by the entry opening 244 but is larger than the first width W1 defined by the remainder of the slot 228 (FIG. 6). Accordingly, the nut 256 is insertable into one of the slots 228 only through the entry opening 244, and the nut 256 cannot be removed from the slot 228 except when aligned with the entry opening 244.

Referring to FIG. 7, the accessory mount 222 includes first and second bores 276, 280 configured to receive the threaded members 260 of the first and second fasteners 248, 252, respectively. In some embodiments, the accessory mount 222 may include more than two bores. The illustrated accessory mount 222 further includes a center recoil lug 284 and first and second split recoil lugs 286, 288 that at least partially surround the first and second bores 276, 280. The recoil lugs 284, 286, 288 project from a bottom side 294 of the accessory mount 222 and are engageable with the slot 228 to transmit at least a portion of recoil forces that occur when firing the firearm 2 directly to the accessory mount 222 (rather than through the first and second fasteners 248, 252).

Figure 8:
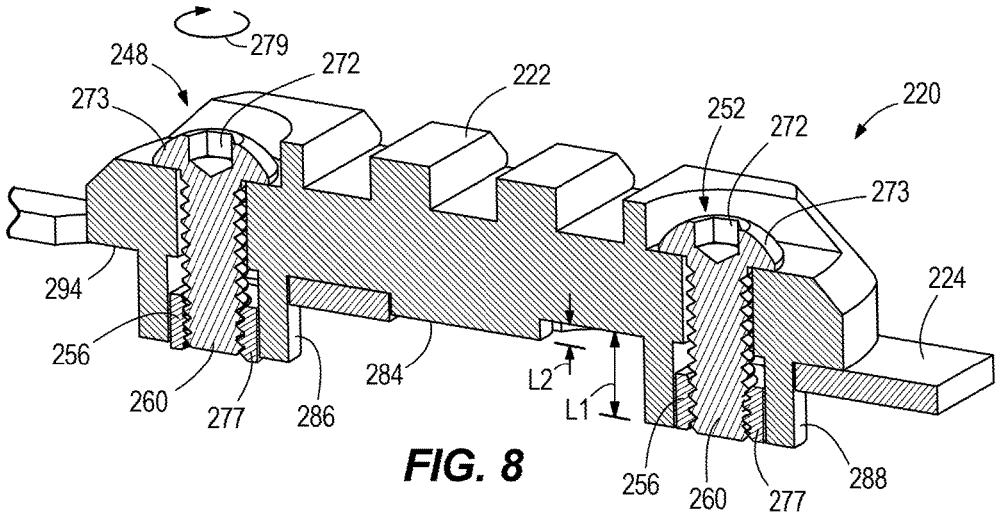
FIG. 8 is a cross-sectional view of the attachment system of FIG. 6 taken along line 8-8 in FIG. 6.

As seen in FIG. 8, in the illustrated embodiment, the split recoil lugs 286, 288 each project a first distance L1 from the bottom side 294 of the accessory mount 222, and the center recoil lug 284 projects a second distance L2 from the bottom side 294 of the accessory mount 222 that is less than the first distance L1. The split recoil lugs 286, 288 extend along the flat sides of the flange portions 277 of the nuts 256 (i.e., the sides of the flange portions 277 extending parallel to the major dimension D3). As such, engagement between the split recoil lugs 286, 288 and the nuts 256 prevents the nuts 256 from rotating with the threaded members 260 relative to the accessory mount 222 while the threaded members 260 are rotated. An anti-rotational feature of this embodiment is therefore provided by the flat sides of the flange portions 277 and the flat surfaces of the split recoil lugs 286, 288. This anti-rotational feature prevents the major dimension D3 of the nuts 256 from aligning with the slot 228. In other embodiments, there do not need to be flat surfaces as long as there is at least a mating surface on each component that prevents relative rotation.

Figure 9A:
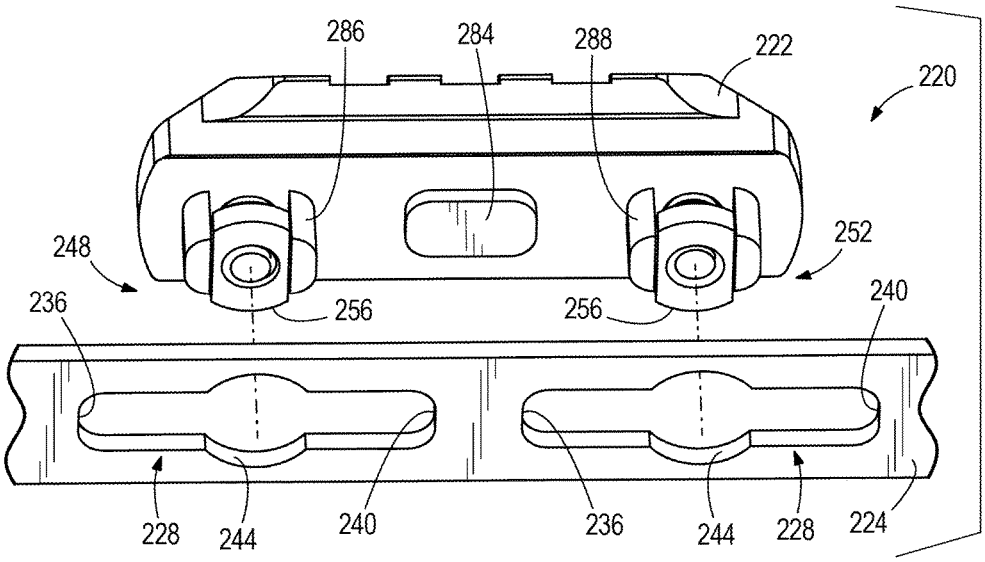
FIGS. 9A-9D are perspective views illustrating operation of the attachment system of FIG. 6.
Figure 9B:
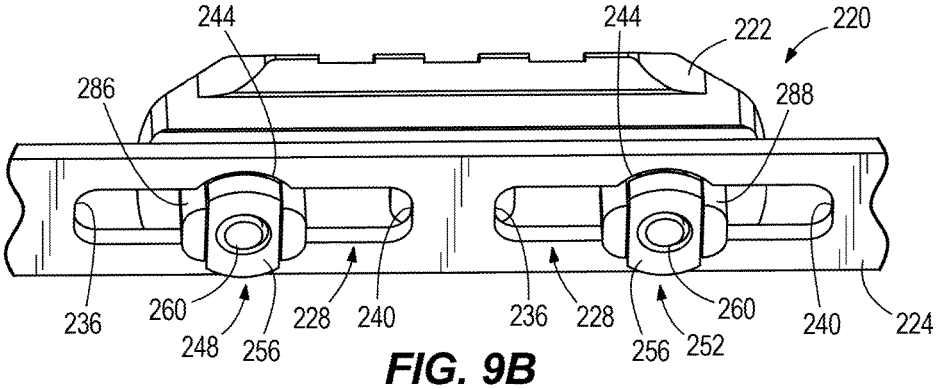
Figure 9C:
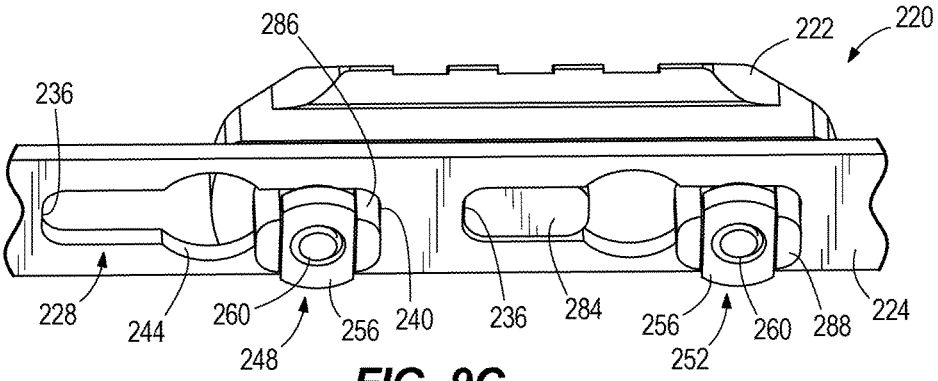
Figure 9D:
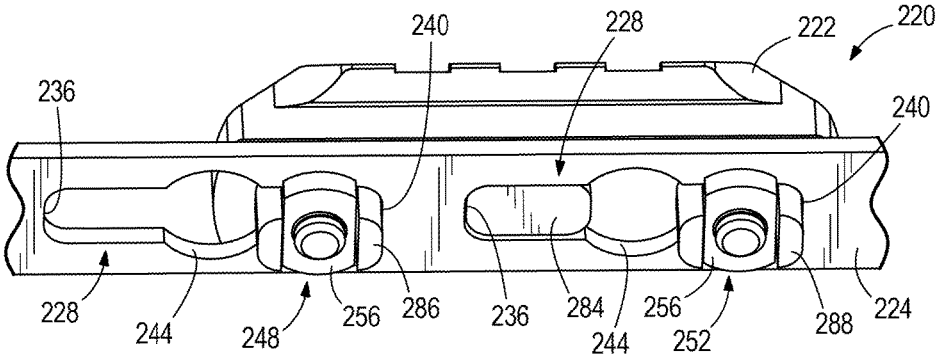
Figure 10:
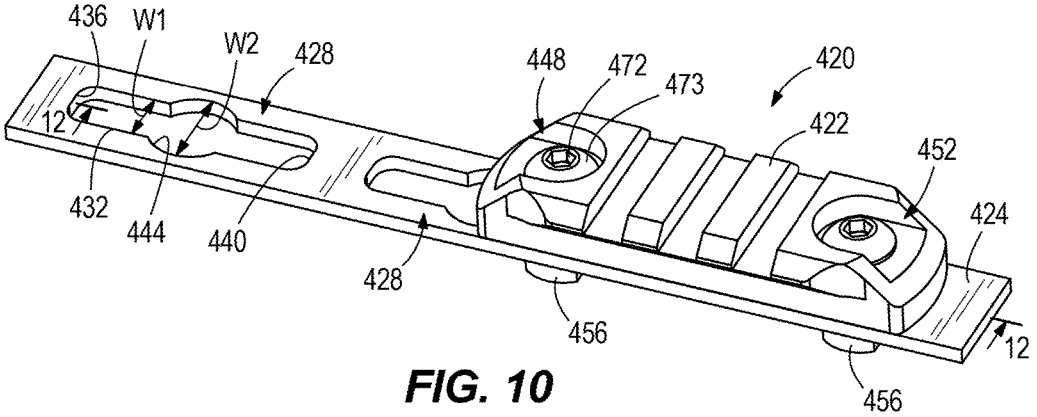
FIG. 10 is a perspective view of an attachment system according to another embodiment of the invention, which may be used to attach accessories to the firearm of FIG. 1.

In operation, an operator uses the attachment system 220 to couple the accessory mount 222 to the rail 224 by first aligning the nuts 256 of the first and second fasteners 248, 252 with the entry openings 244 of two adjacent slots 228 (FIG. 9A). Next, the operator moves the accessory mount 222 toward the rail 224 to insert the nuts 256 (and the split recoil lugs 286, 288) through the entry openings 244 (FIG. 9B). The operator then slides the accessory mount 222 (and with it, the fasteners 248, 252) to move the fasteners 248, 252 toward either the first end 236 or the second end 240 of the slots 228. In the illustrated embodiment, the fasteners 248, 252 are moved toward the second end 240. As the fasteners 248, 252 approach the second end 240, the center recoil lug 284 aligns with the slot 228 receiving the second fastener 252 (FIG. 9C), and the accessory mount 222 can then be moved slightly closer to the rail 224 (by a distance equal to the projecting distance L2 of the center recoil lug 284). In this position, the first split recoil lug 286 abuts the second end 240 of the slot 228 receiving the first fastener 248, the center recoil lug 284 abuts the first end 236 of the slot 228 receiving the second fastener 252, and the second split recoil lug 288 abuts the second end 240 of the slot 228 receiving the second fastener 252. Finally, the operator rotates each threaded member 260 in a clockwise direction 279 (FIG. 8) to draw the nut 256 toward the flange 273 on the threaded member 260 (FIG. 9D). The accessory mount 222 and the rail 224 are clamped between the flange portion 277 of the nut 256 and the flange 273 of the threaded member 260 to secure the accessory mount 222 to the rail 224. The nuts 256 do not rotate with respect to the accessory mount 222 due to the engagement between the mating flat surfaces of the nuts 256 and the split recoil lugs 286, 288. Thus, the nuts 256 are maintained in an orientation with the major dimension D3 oriented transverse to the slot 228. To remove the accessory mount 222, the operator loosens the fasteners 248, 252 by rotating each threaded member 260 counterclockwise. The operator then lifts up on the accessory mount 222 to withdraw the center recoil lug 284 from the slot 228, and then slides the accessory mount 222 to align the nuts 256 with the entry openings 244.

FIGS. 10-13D illustrate an attachment system 420 according to another embodiment. The attachment system 420 is similar to the attachment system 220 described above with reference to FIGS. 6-9D. Accordingly, features and elements of the attachment system 420 of FIGS. 10-13D corresponding with features and elements of the attachment system 220 of FIGS. 6-9D are given like reference numbers plus 200. In addition, the following description focuses primarily on differences between the attachment system 420 and the attachment system 220.

Figure 11:
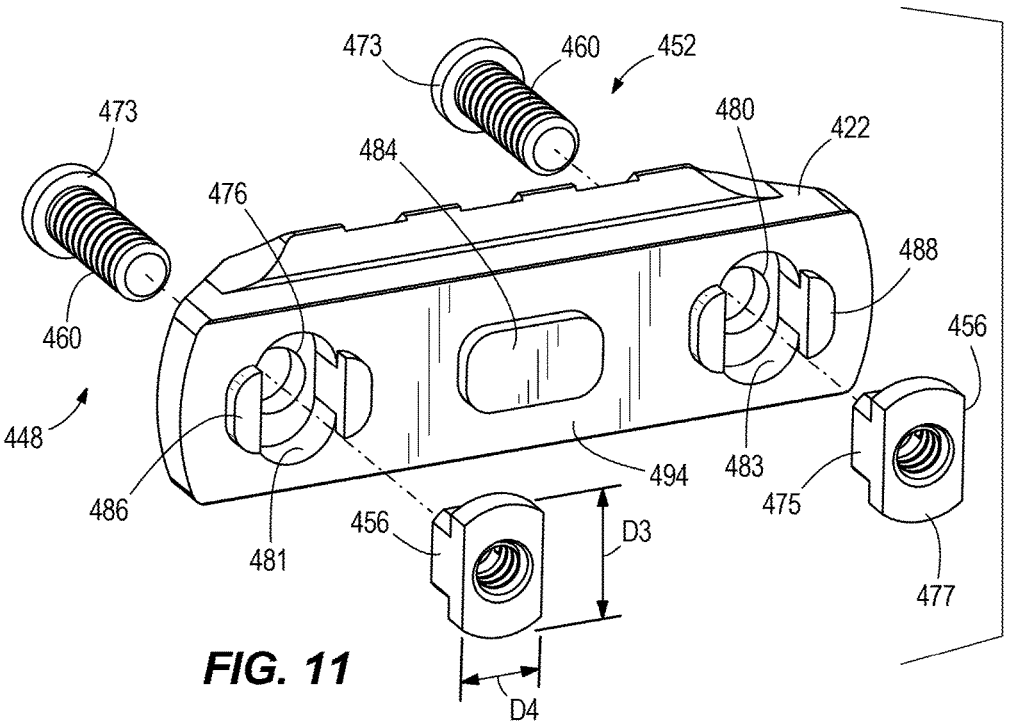
FIG. 11 is an exploded perspective view of the attachment system of FIG. 10.

The fasteners 448, 452 of the attachment system 420 each include a threaded member 460 and a generally T-shaped nut 456 having a stem portion 475 and a flange portion 477. The flange portion 477 defines a major dimension D3 and a minor dimension D4 that is less that the major dimension D3 (FIG. 11). The stem portions 475 of each nut 456 are longer than the stem portions 275 of the nuts 256 of the attachment system 220.

Referring to FIG. 11, the accessory mount 422 includes first and second bores 476, 480 configured to receive the threaded members 460 of the first and second fasteners 448, 452, respectively. In addition, the accessory mount 422 further includes first and second recesses 481, 483, formed in the bottom side 494 of the accessory mount 422, that are aligned with the first and second bores 476, 480. Each of the recesses 481, 483 is sized and shaped to receive the stem portion 475 of the corresponding nut 456. The walls of each recess 481, 483 extend along the sides of the nut 456 that extend parallel to the major dimension D3. This prevents the nuts 456 from rotating with the threaded members 460 relative to the accessory mount 422 when the threaded members 460 are rotated, thereby preventing the major dimension D3 of the nuts 456 from aligning with the slot 428. An anti-rotational feature of this embodiment is provided by flat surfaces in the walls of the recesses 481, 483 and of the split recoil lugs 486, 488 which mate with flat surfaces of the stem portions 475 of the nuts 456. In other embodiments, there do not need to be flat surfaces as long as there is at least a mating surface on each component that prevents relative rotation.

Figure 12:
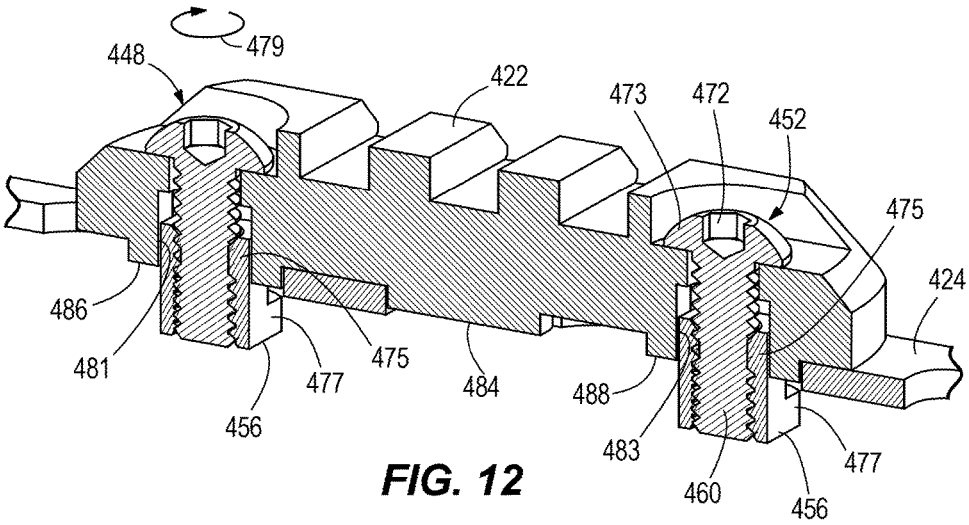
FIG. 12 is a cross-sectional view of the attachment system of FIG. 10 take along line 12-12 in FIG. 10.

The illustrated accessory mount 422 further includes a center recoil lug 484 and first and second split recoil lugs 486, 488 that at least partially surround the first and second recesses 481, 483. The recoil lugs 484, 486, 488 project from the bottom side 494 of the accessory mount 422 and are engageable with the slot 428 to transmit at least a portion of recoil forces that occur when firing the firearm 2 directly to the accessory mount 422 (rather than through the first and second fasteners 448, 452). The split recoil lugs 486, 488 of the accessory mount 422 are shorter than the split recoil lugs 286, 288 of the accessory mount 222. In the illustrated embodiment, the center recoil lug 484 and the split recoil lugs 486, 488 project the same distance from the bottom side 494 of the accessory mount 422. (FIG. 12)

Figure 13A:
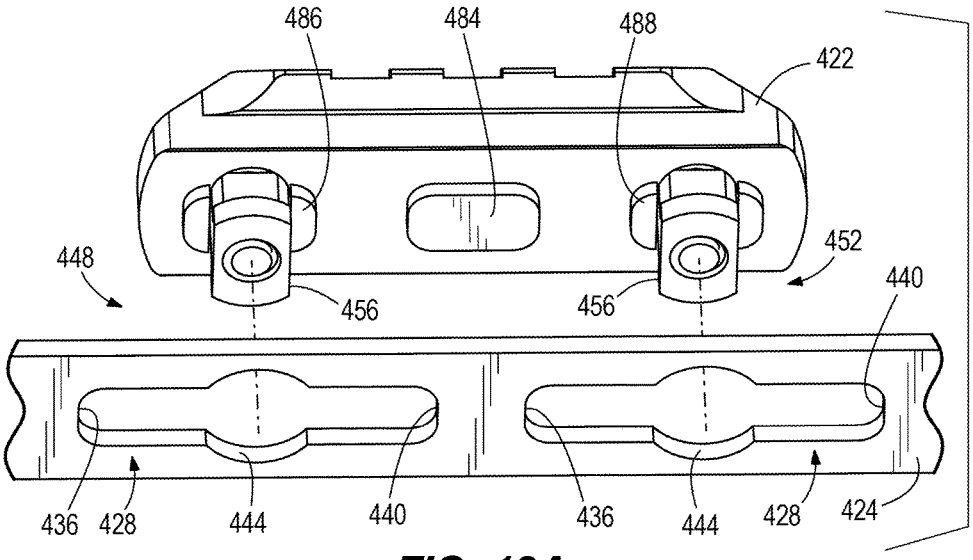
FIGS. 13A-13D are perspective views illustrating operation of the attachment system of FIG. 10.
Figure 13B:
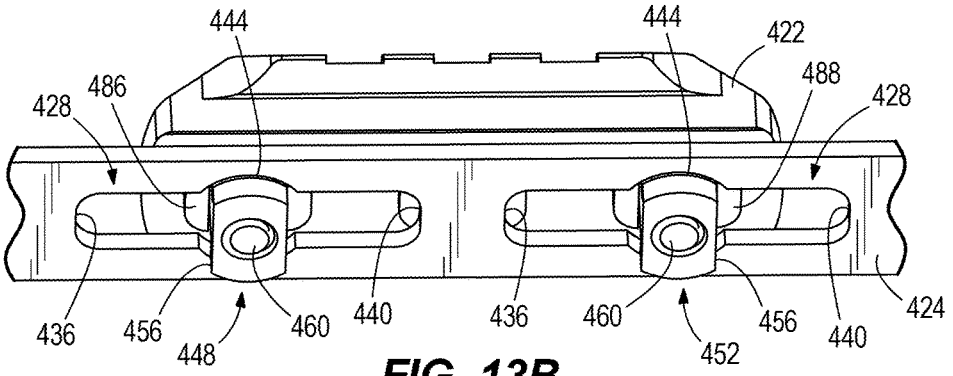
Figure 13C:
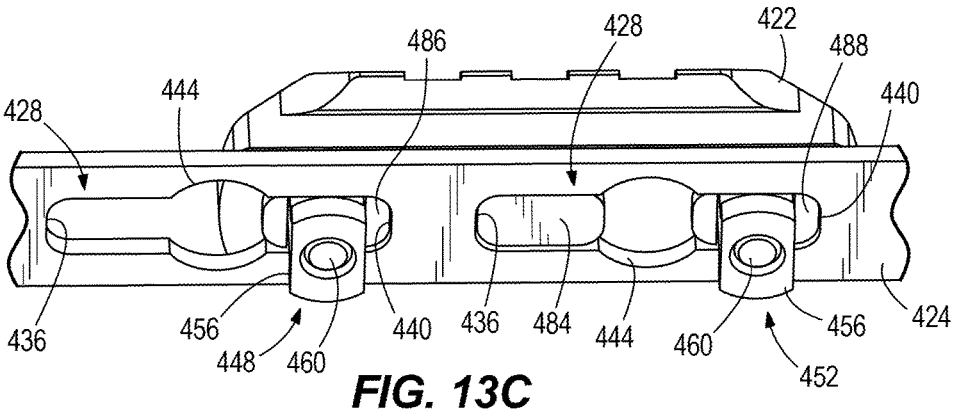
Figure 13D:
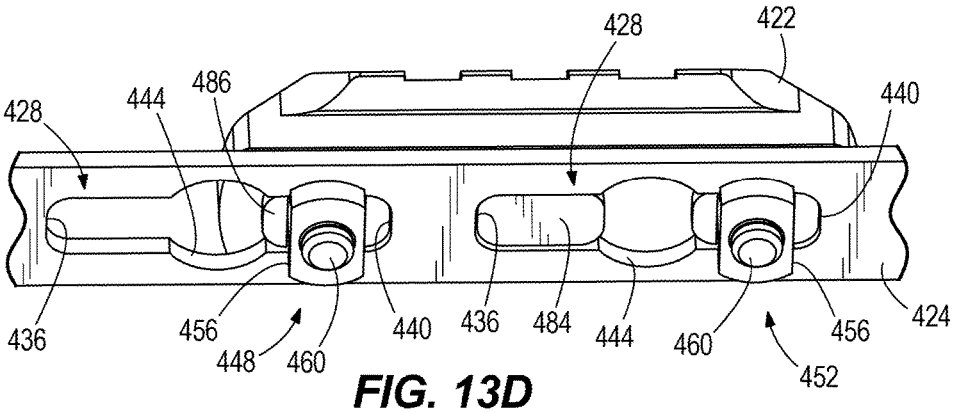
Figure 14:
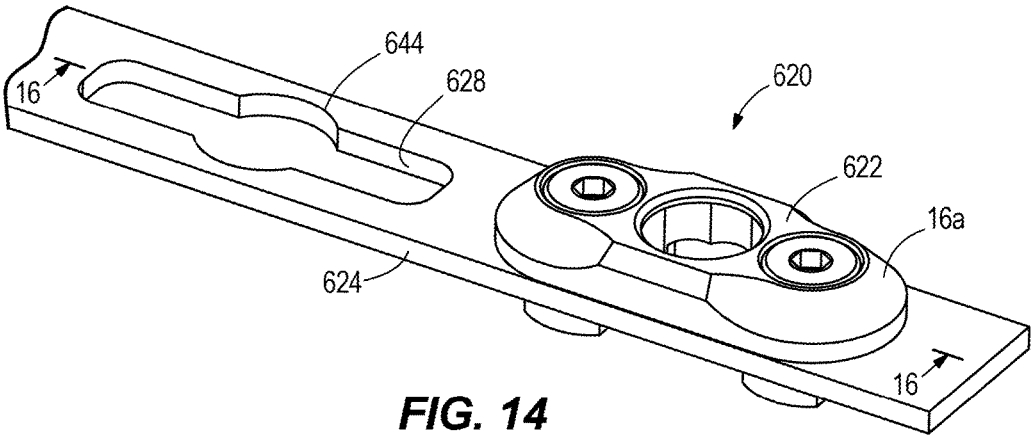
FIG. 14 is a perspective view of an attachment system according to another embodiment of the invention, which may be used to attach a shoulder sling mount to the firearm of FIG. 1.

In operation, an operator uses the attachment system 420 to couple the accessory mount 422 to the rail 424 by first aligning the nuts 456 of the first and second fasteners 448, 452 with the entry openings 444 of two adjacent slots 428 (FIG. 13A). Next, the operator moves the accessory mount 422 toward the rail 424 to insert the nuts 456 (and the split recoil lugs 486, 488) through the entry openings 444 (FIG. 13B). The operator then slides the accessory mount 422 (and with it, the fasteners 448, 452) to move the fasteners 448, 452 toward either the first end 436 or the second end 440 of the slots 428. In the illustrated embodiment, the fasteners 448, 452 are moved toward the second end 440. As the fasteners 448, 452 approach the second end 440, the center recoil lug 484 aligns with the slot 428 receiving the second fastener 452 (FIG. 13C), and the accessory mount 422 can then be moved slightly closer to the rail 424 (by a distance equal to the projecting distance L2 of the center recoil lug 484). In this position, the first split recoil lug 486 abuts the second end 440 of the slot 428 receiving the first fastener 448, the center recoil lug 484 abuts the first end 436 of the slot 428 receiving the second fastener 452, and the second split recoil lug 488 abuts the second end 440 of the slot 428 receiving the second fastener 452. Finally, the operator rotates each threaded member 460 in a clockwise direction 479 (FIG. 12) to draw the nut 456 toward the flange 473 on the threaded member 460 (FIG. 13D). The accessory mount 422 and the rail 424 are clamped between the flange portion 477 of the nut 456 and the flange 473 of the threaded member 460 to secure the accessory mount 422 to the rail 424. The nuts 456 do not rotate due to the engagement between the sides of stem portion 475 and the walls of the recesses 481, 483. Thus, the nuts 456 are maintained in an orientation with the major dimension D3 oriented transverse to the slot 428. To remove the accessory mount 422, the operator loosens the fasteners 448, 452 by rotating each threaded member 460 counterclockwise. The operator then lifts up on the accessory mount 422 to withdraw the center recoil lug 484 from the slot 428, and then slides the accessory mount 422 to align the nuts 456 with the entry openings 444.

FIGS. 14-17D illustrate an attachment system 620 according to another embodiment. The attachment system 620 is similar to the attachment system 420 described above with reference to FIGS. 10-13D. Accordingly, features and elements of the attachment system 620 of FIGS. 14-17D corresponding with features and elements of the attachment system 420 of FIGS. 10-13D are given like reference numbers plus 200. In addition, the following description focuses primarily on differences between the attachment system 620 and the attachment system 420. In addition, features and elements of any of the other attachment systems 20, 220, 420 described herein.

Figure 15:
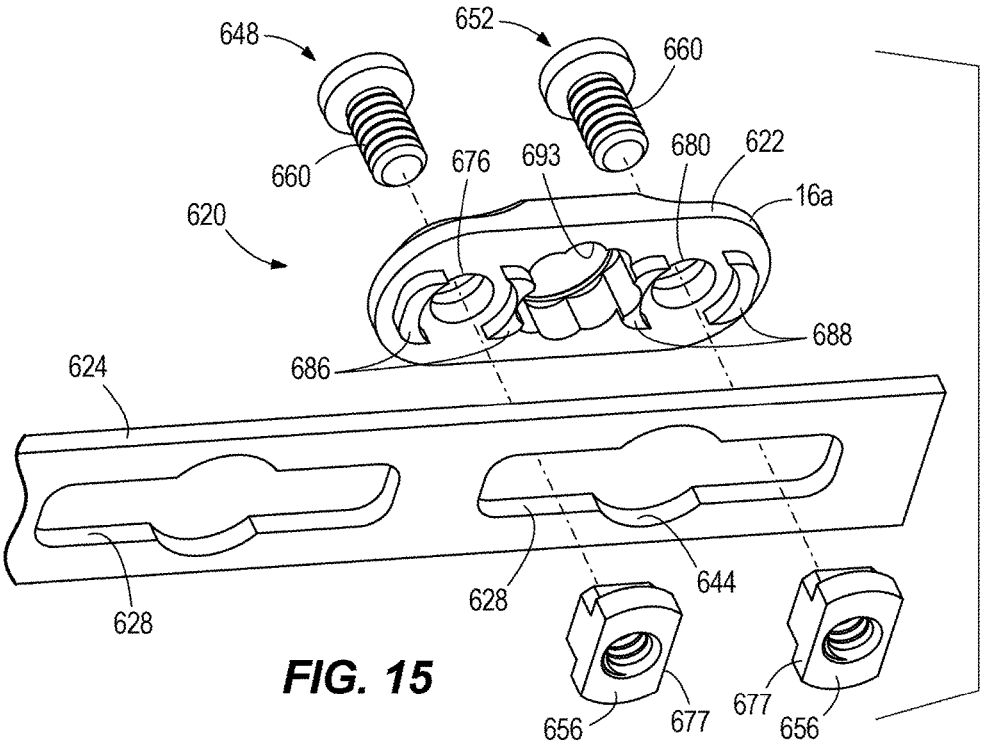
FIG. 15 is an exploded perspective view of the attachment system of FIG. 14.
Figure 16:
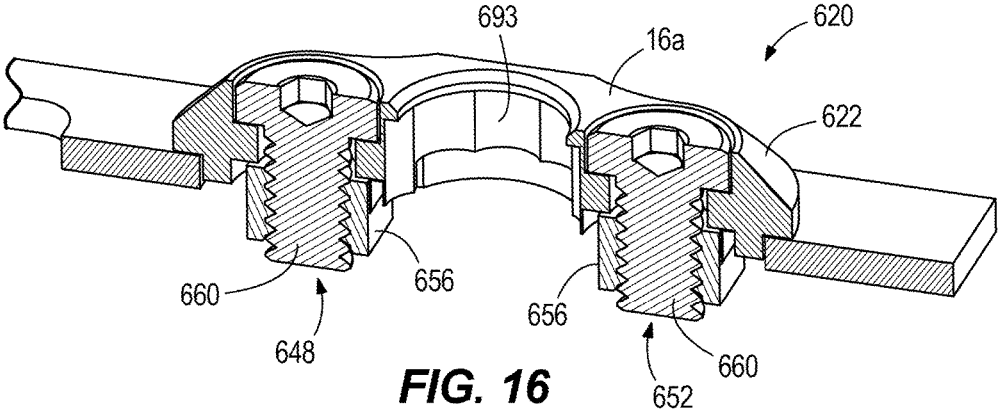
FIG. 16 is a cross-sectional view of the attachment system of FIG. 14 taken along line 16-16 in FIG. 14.

Referring to FIG. 15, the accessory 16 is embodied as a shoulder sling mount 16*a* including the accessory mount 622, first and second bores 676, 680 configured to receive the threaded members 660 of the first and second fasteners 648, 652, and first and second split recoil lugs 686, 688. The fasteners 648, 652 and accessory mount 622 are configured such that each of the fasteners 648, 652 is rotatable between a first orientation (FIGS. 17A-B), in which the major dimension of the flange 677 of the nut 656 is oriented along the length of the accessory mount 622, and a second orientation (FIGS. 17C-D), in which the major dimension of flange 677 of the nut 656 is oriented along the width of the accessory mount 622. That is, the first orientation and the second orientation are offset by 90 degrees. The nuts 656 initially rotate to the second orientation as the fasteners 648, 652 are rotated in a tightening direction. The nuts 656 may engage portions of the accessory mount 622 and/or the rail 624 to prevent further rotation of the nuts 656 beyond the second orientation.

The shoulder sling mount 16*a* also includes a central aperture 693. The central aperture 693 of the shoulder sling mount 16*a* is configured to receive a swivel fitting (not shown), which in turn can be connected to a shoulder strap, thus providing a swiveling connection between the shoulder strap and the shoulder sling mount 16*a*.

Figure 17A:
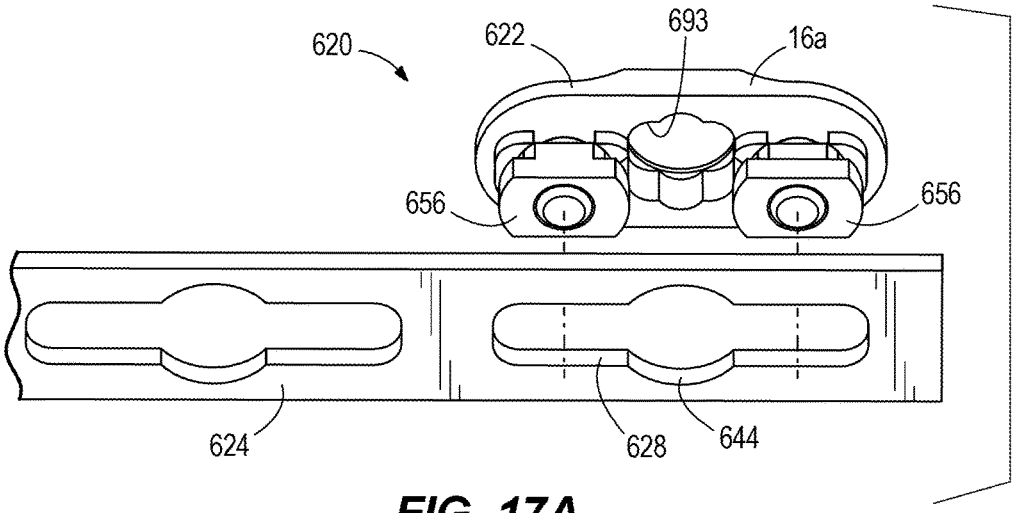
FIGS. 17A-17D are perspective views illustrating operation of the attachment system of FIG. 14.
Figure 17B:
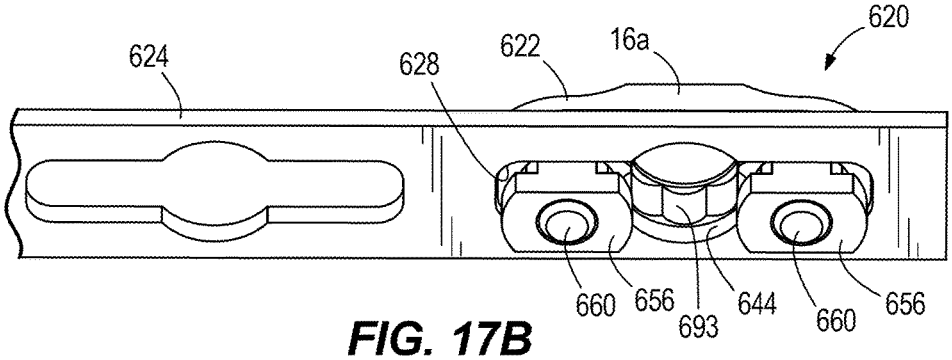
Figure 17C:
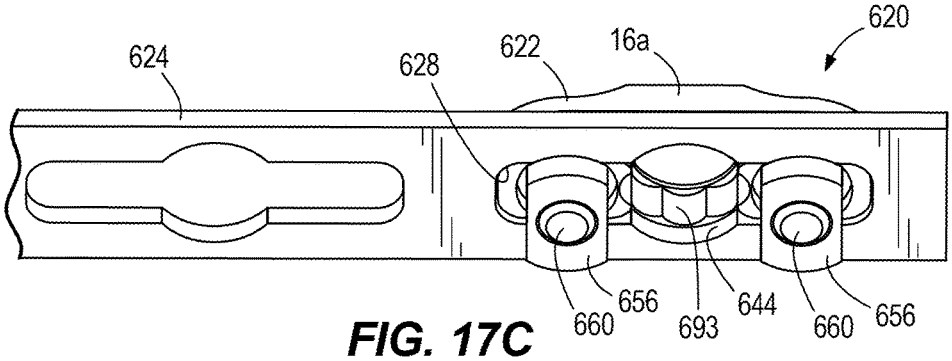
Figure 17D:
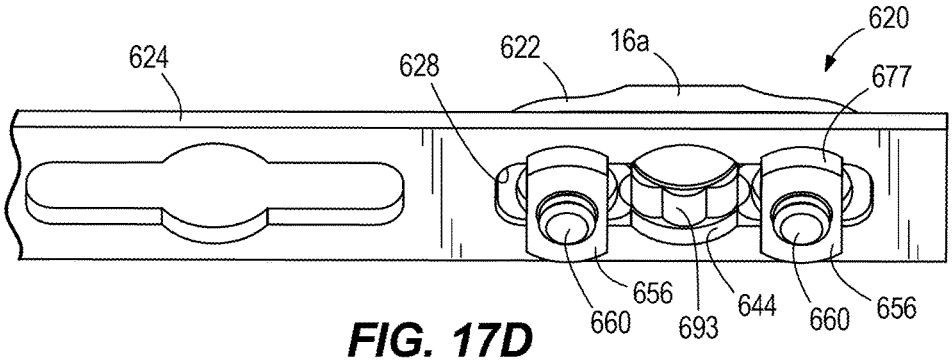

In operation, an operator uses the attachment system 620 to couple the shoulder sling mount 16*a* to the rail 624 by first aligning the nuts 656 of the first and second fasteners 648, 652 with a single slot 628, with the nuts 656 in the first orientation (FIG. 17A). The user then inserts the heads of the nuts 656 into the slot 628 (FIG. 17B). Next, the operator rotates each threaded member 660 in a tightening direction, which causes the nuts 656 to rotate to the second orientation (FIG. 17C). Further rotation of the threaded member 660 in the tightening direction draws the nut 656 against the underside of the rail 624 to clamp the rail 624 between the flange 677 of each nut 656 and the underside of the accessory mount 622 (FIG. 17D).

The configuration of the rail 624 and slot 628 is particularly advantageous when used in connection with the shoulder sling mount 16*a*. The entry opening 644 in the center of the slot 628 aligns with the central aperture 693 of the shoulder sling mount 16*a* when the shoulder sling mount 16*a* is coupled to the rail 624 as described above. This allows portions of the swivel fitting to extend into the entry opening 644, in turn allowing for a reduction in the overall thickness of the shoulder sling mount 16*a*.

Thus, the present invention provides an accessory mounting system that includes an elongated opening having first and second ends and an entry aperture between the first and second ends. Because of this configuration, a fastener with a T-nut or circular head can be inserted into the entry aperture and slid toward either of the first and second ends of the elongated opening. If a T-nut is used, it can be inserted already transverse to the elongated opening. Either type of fastener can be tightened against the handguard in the elongated opening without rotating the fastener head.

Various features and advantages of the invention are set forth in the following claims.

What is claimed is:

1. An attachment system for securing accessories to a firearm having a barrel, the attachment system comprising:

an accessory mount including a lug;

a fastener including a fastener head, the fastener head defining a major dimension and a minor dimension, the minor dimension being not equal to the major dimension;

a handguard extending along a portion of the barrel; and a plurality of slots in the handguard for receiving attachments, each slot defining an elongated opening extending between first and second opposite ends, the elongated opening have a first width, and an entry opening interrupting the elongated opening between the first and second end, the entry opening having a second width larger than the first width;

wherein the second width is larger than the major dimension of the fastener head and the first width is smaller than the major dimension such that the fastener head is insertable into the slot through the entry opening, movable in the slot toward either of the first and second ends, and securable to the handguard by tightening the fastener head against the handguard; and wherein the lug extends from the accessory mount alongside the fastener head to prevent the major dimension from aligning with the slot.

2. The attachment system of claim 1, wherein the entry opening is circular.

3. The attachment system of claim 1, wherein the entry opening is centered between the first and second ends.

4. The attachment system of claim 1, wherein the lug of the accessory is a recoil lug adapted to engage the first or second end of the slot when the accessory is mounted to the handguard.

5. The attachment system of claim 1, wherein the fastener head is securable to the handguard by tightening the fastener head against the handguard without rotating the fastener head.

6. An attachment system for securing an accessory to a firearm, the attachment system comprising:

an accessory mount including a lug;

a rail including a plurality of slots, each slot defining an elongated opening extending between first and second opposite ends, the elongated opening have a first width, and an entry opening interrupting the elongated opening between the first and second end, the entry opening having a second width larger than the first width; and a fastener having a fastener head defining a major dimension and a minor dimension, the minor dimension being not equal to the major dimension, wherein the major dimension is larger than the first width and smaller than the second width such that the fastener head is insertable into the slot through the entry opening, movable in the slot toward either of the first and second ends, and securable to the rail by tightening the fastener head against the rail; and wherein the lug extends from the accessory mount alongside the fastener head to prevent the major dimension from aligning with the slot.

7. The attachment system of claim 6, wherein the entry opening is circular.

8. The attachment system of claim 6, wherein the entry opening is centered between the first and second ends.

9. The attachment system of claim 6, wherein the lug is a recoil lug adapted to engage the first or second end of the slot when the accessory is mounted to the rail.

10. The attachment system of claim 6, wherein the fastener head is securable to the rail by tightening the fastener head against the rail without rotating the fastener head.

11. The attachment system of claim 6, wherein the fastener head is a generally T-shaped nut.

12. The attachment system of claim 6, wherein the accessory is a shoulder sling mount.

13. The attachment system of claim 12, wherein the shoulder sling mount includes a central aperture configured to receive a swivel fitting, and wherein the central aperture aligns with the entry opening when the shoulder sling mount is secured to the firearm.

* * * * *